US006820609B2

(12) United States Patent
Woodall, III et al.

(10) Patent No.: US 6,820,609 B2
(45) Date of Patent: Nov. 23, 2004

(54) LOW-PROFILE VENTILATION HOOD

(75) Inventors: William Miles Woodall, III, Dallas, TX (US); Christopher R. Koontz, Richardson, TX (US)

(73) Assignee: Vent-A-Hood Ltd., Richardson, TX (US)

( * ) Notice: Subject to any disclaimer, the term of this patent is extended or adjusted under 35 U.S.C. 154(b) by 208 days.

(21) Appl. No.: 10/116,154

(22) Filed: Apr. 3, 2002

(65) Prior Publication Data

US 2003/0188733 A1 Oct. 9, 2003

(51) Int. Cl.[7] ..... F24C 15/20
(52) U.S. Cl. ..... 126/299 R; 126/299 D
(58) Field of Search ..... 126/299 R, 299 D, 126/301; 55/DIG. 36; 454/57; 417/423.14, 424.1, 423.1; 415/119, 120

(56) References Cited

U.S. PATENT DOCUMENTS

| | | | | |
|---|---|---|---|---|
| 2,077,496 | A | 4/1937 | Sonntag | 98/115 |
| 2,182,106 | A | 12/1939 | Ames | 126/299 |
| 2,226,641 | A | 12/1940 | Sonntag | 98/115 |
| 2,341,245 | A | 2/1944 | Sonntag | 98/115 |
| 2,349,668 | A | 5/1944 | Marker et al. | 98/43 |
| 2,369,375 | A | 2/1945 | Sonntag | 21/74 |
| 2,456,391 | A | 12/1948 | Davies | 98/94 |
| 2,619,023 | A | 11/1952 | Kisling | 98/94 |
| 2,633,071 | A | 3/1953 | Erickson | 98/115 |
| 2,634,718 | A | 4/1953 | Williams | 126/21 |
| 2,710,573 | A | 6/1955 | Marker | 98/43 |
| 2,793,712 | A | 5/1957 | Graswich et al. | 126/299 R |
| 2,857,836 | A | 10/1958 | Bernstein | 98/43 |
| 2,862,437 | A | 12/1958 | Smith et al. | 98/115 |
| 2,868,108 | A | 1/1959 | Petersen | 98/115 |
| 2,886,124 | A | 5/1959 | Scharmer | 183/37 |
| 2,889,007 | A | 6/1959 | Lunde | 126/299 D |
| 2,893,305 | A | 7/1959 | Jenson et al. | 98/115 |
| 3,064,551 | A | 11/1962 | Stalker | 98/115 |
| 3,125,869 | A | 3/1964 | Winton | 62/317 |
| 3,251,290 | A | 5/1966 | Jenson et al. | 98/115 |
| 3,393,497 | A | 7/1968 | Donnelly | 126/299 D |
| 3,496,704 | A | 2/1970 | Bandlow | 55/316 |
| 3,589,266 | A | 6/1971 | Hike et al. | 98/115 |
| 3,625,135 | A | 12/1971 | Carlson et al. | 98/155 |
| 3,690,245 | A | 9/1972 | Ferlise et al. | 98/115 |
| 3,834,295 | A | 9/1974 | Seidel | 98/115 |
| 3,865,022 | A | 2/1975 | Alrich | 98/115 K |
| 3,983,796 | A | 10/1976 | Alrich | 98/115 K |
| 4,088,123 | A | 5/1978 | Bowen, Jr. et al. | 126/299 D |
| 4,089,328 | A | 5/1978 | Bergmark et al. | 126/299 D |
| 4,105,015 | A | 8/1978 | Isom | 126/299 D |
| 4,120,290 | A | 10/1978 | Bowen, Jr. et al. | 126/299 D |

(List continued on next page.)

FOREIGN PATENT DOCUMENTS

| | | | | |
|---|---|---|---|---|
| EP | 0 363 329 | * | 4/1990 | 126/299 D |
| FR | 2308973 | | 11/1976 | 126/299 D |
| JP | 61-114039 | * | 5/1986 | 126/299 D |
| JP | 3-251632 | * | 11/1991 | 126/299 D |
| JP | 4-106346 | | 4/1992 | 126/299 D |
| JP | 4-260740 | | 9/1992 | 126/299 D |

*Primary Examiner*—James C. Yeung
(74) *Attorney, Agent, or Firm*—Gardere Wynne Sewell LLP; Kenneth T. Emanuelson

(57) ABSTRACT

The present invention provides a method, apparatus and system for safely and efficiently evacuating a ventilation hood having at least one blower unit disposed within a hood. The present invention incorporates an upper plenum frame having an opening in the bottom thereof. A squirrel cage fan is disposed about the opening to draw air down through the upper plenum frame, through a lower plenum, and out an exhaust duct connected to the lower plenum. In certain embodiments, the squirrel cage fan is driven at a speed appropriate to liquefy grease suspended in the heated air.

20 Claims, 4 Drawing Sheets

U.S. PATENT DOCUMENTS

| | | | | | |
|---|---|---|---|---|---|
| 4,121,199 | A | | 10/1978 | Young | 340/611 |
| 4,121,569 | A | | 10/1978 | Bowen, Jr. et al. | 126/299 D |
| 4,122,835 | A | | 10/1978 | Bowen, Jr. et al. | 126/299 D |
| 4,130,111 | A | | 12/1978 | Ristic | 126/299 D |
| 4,133,300 | A | | 1/1979 | Burton, Jr. et al. | 126/299 D |
| 4,146,016 | A | | 3/1979 | Bowen, Jr. et al. | 126/299 D |
| 4,166,448 | A | | 9/1979 | Miller et al. | 126/299 D |
| 4,235,220 | A | | 11/1980 | Hepner | 126/299 D |
| 4,327,274 | A | | 4/1982 | White et al. | 219/10.55 R |
| 4,560,395 | A | * | 12/1985 | Davis | 96/381 |
| 4,741,257 | A | | 5/1988 | Wiggin et al. | 98/115.3 |
| 4,903,685 | A | | 2/1990 | Melink | 126/299 D |
| 5,074,281 | A | | 12/1991 | Fluhrer et al. | 126/299 D |
| 5,211,159 | A | | 5/1993 | Lieblein et al. | 126/299 R |
| 5,421,320 | A | | 6/1995 | Brown | 126/299 R |
| 5,642,784 | A | | 7/1997 | Guay et al. | 169/61 |
| 5,656,170 | A | | 8/1997 | Henderson | 210/656 |
| 5,690,093 | A | | 11/1997 | Schrank et al. | 126/299 E |
| 5,755,214 | A | | 5/1998 | Lai | 126/299 E |
| 5,775,319 | A | * | 7/1998 | Pettinari | 126/299 R |
| 6,142,142 | A | | 11/2000 | Woodall, III et al. | 126/299 R |
| 6,170,480 | B1 | * | 1/2001 | Melink et al. | 126/299 R |

* cited by examiner

LOW-PROFILE VENTILATION HOOD

FIELD OF THE INVENTION

The present invention relates generally to ventilation hoods and more specifically to an apparatus and system for safely and efficiently ventilating the area above a stovetop or similar cooking device using a compact low-noise device.

BACKGROUND OF THE INVENTION

Cooking creates undesirable by-products, such as heat, steam, grease and odors. These cooking by-products pollute the air in a home or commercial environment if they are not safely removed. These cooking by-products are irritating, harmful and potentially hazardous. Accordingly, a multitude of ventilation systems have been developed to draw the cooking by-products away from the immediate vicinity of the cooking area and to expel this contaminated air to an external environment through an exhaust duct.

The heat generated from cooking expands the air in the cooking area and it rises, carrying with it the cooking by-products. Typical ventilation systems use a hood placed above the cooking area to capture the by-products prior to removal by a blower system. The hood is like a small room wherein too much airflow is as harmful as too little. If too much air is removed from a well insulated home, a negative pressure results rendering the ventilation system ineffective unless expensive make-up air is introduced. As a result the blower system should be sized based on the expected usage of the cooking area. For example, a barbecue grill, or wok should be measured at full value because they are most often at the high setting. Multiple burners, however, are rarely all turned to the high setting at any one time and should be discounted.

If the size of the blower system is too small, the fan will under-exhaust allowing heat and/or cooking by-products to escape from the hood into the kitchen and, perhaps, the rest of the facility. On the other hand, if the size of the blower system is too large, the fan will over-exhaust allowing too much air to be expelled while the motor is consuming energy unnecessarily. As a result, the air heated or cooled by the air conditioning system of the building is also exhausted to the outside, causing the thermostat of the air conditioner to run the air conditioning system to replace the exhausted air. This resulting inefficiency increases the owner's utility bills and needlessly wastes energy.

Another factor limiting the airflow capacity of the blower system relates to the physical size of the hood itself. In many cases, the optimal airflow rating for a traditional blower system can only be achieved using a hood that is unacceptably large, both physically and aesthetically, to many potential users and purchasers of the hood.

Finally, blower noise is a major concern for many installations, especially in residential applications. As a result, less-than-optimal airflow capacity is often accepted to reduce the blower noise.

SUMMARY OF THE INVENTION

The present invention provides a method and apparatus for ventilating the area above a cooking area. The present invention provides a ventilation hood system for exhausting air containing cooking by-products from a cooking station to an external environment through an exhaust duct.

The ventilation hood system of the present invention is designed to minimize the size of the hood, particularly in the vertical dimension, while at the same time optimizing the airflow through the hood in order to thoroughly evacuate the cooking by-products. Prior low-profile hoods have been developed, but such hoods have exhibited insufficient airflow capability for use in many applications. The ventilation hood of the present invention accomplishes both goals in a compact, low-noise device. As such, the ventilation hood of the present invention represents a significant improvement over prior ventilation hoods.

The ventilation hood system of the present invention incorporates a hood, a blower unit and a blower control unit. The hood is of sufficient size and design to hold the cooking by-products prior to evacuation from the hood. The blower unit is disposed within the hood and capable of removing the cooking by-products from within the hood and liquefying and containing grease. The blower control unit may incorporate a speed controller having variable settings, such as a first, second and third setting.

In contrast to prior designs, the method and apparatus of the present invention draws hot air and cooking by-products in from the upper portion of the hood, where such hot air and cooking by-products naturally rise. The hot air and cooking by-products are drawn down into the center of the blower by the rotary action of a radial fan disposed in the lower portion of the blower.

In a first embodiment of the present invention, the invention is an apparatus for ventilating a hood apparatus incorporating an upper plenum frame having an inlet and having an outlet disposed in the bottom thereof acting in concert with a lower plenum having an inlet disposed in the top thereof connected to the outlet of the upper plenum frame and having an outlet. The apparatus also incorporates a squirrel cage fan disposed within the lower plenum having an inner profile and an axis, the axis disposed vertically and the inner profile of the squirrel cage fan being disposed about the inlet of the lower plenum.

In a second embodiment, the invention is an apparatus for ventilating a hood apparatus having an upper inner surface, the apparatus incorporating a substantially-rectangular upper frame mounted to the hood and disposed substantially parallel to, and a fixed distance from, the upper inner surface of the hood and having a circular outlet disposed in the bottom thereof. The apparatus also incorporates a lower plenum having a circular inlet disposed in the top thereof connected to the circular outlet of the upper plenum frame and having an outlet on the side thereof. Finally, the apparatus incorporates a squirrel cage fan disposed about a fan motor within the lower plenum, having an inner profile and an axis, the axis disposed vertically and the inner profile of the squirrel cage fan being disposed about the circular inlet of the lower plenum.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention and do not delimit the scope of the invention.

The blower system of the present invention provides a powerful, efficient, safe and quiet kitchen ventilation system that can be installed in a home or commercial setting. The blower system employs a geometry in which a squirrel cage fan is disposed about a vertical axis, in contrast to the horizontal axis employed in prior designs. Orientation of the fan in this vertical orientation allows for a low profile hood and quieter operation as compared to prior designs.

The fan is disposed within the lower portion of the blower assembly, drawing air from above, rather than below. The vapors in the upper portion of the hood, from which the blower system draws, generally represent the highest-temperature vapors presenting the highest risk of fire hazard. Further, drawing vapors from the upper portion of the hood means that evacuation of the hood can be accomplished without higher-than-necessary airflow and attendant fan noise.

The blower system of the present invention liquefies cooking grease and vapors in the blower and exhausts purified air into the duct. This method of quiet grease extraction from the air is superior to other ventilation systems because no mesh or baffle filters are used to slow the removal of heat polluted air. Moreover, the centrifugal action of the blower unit prevents flames from passing through into the exhaust duct.

Figure 1:
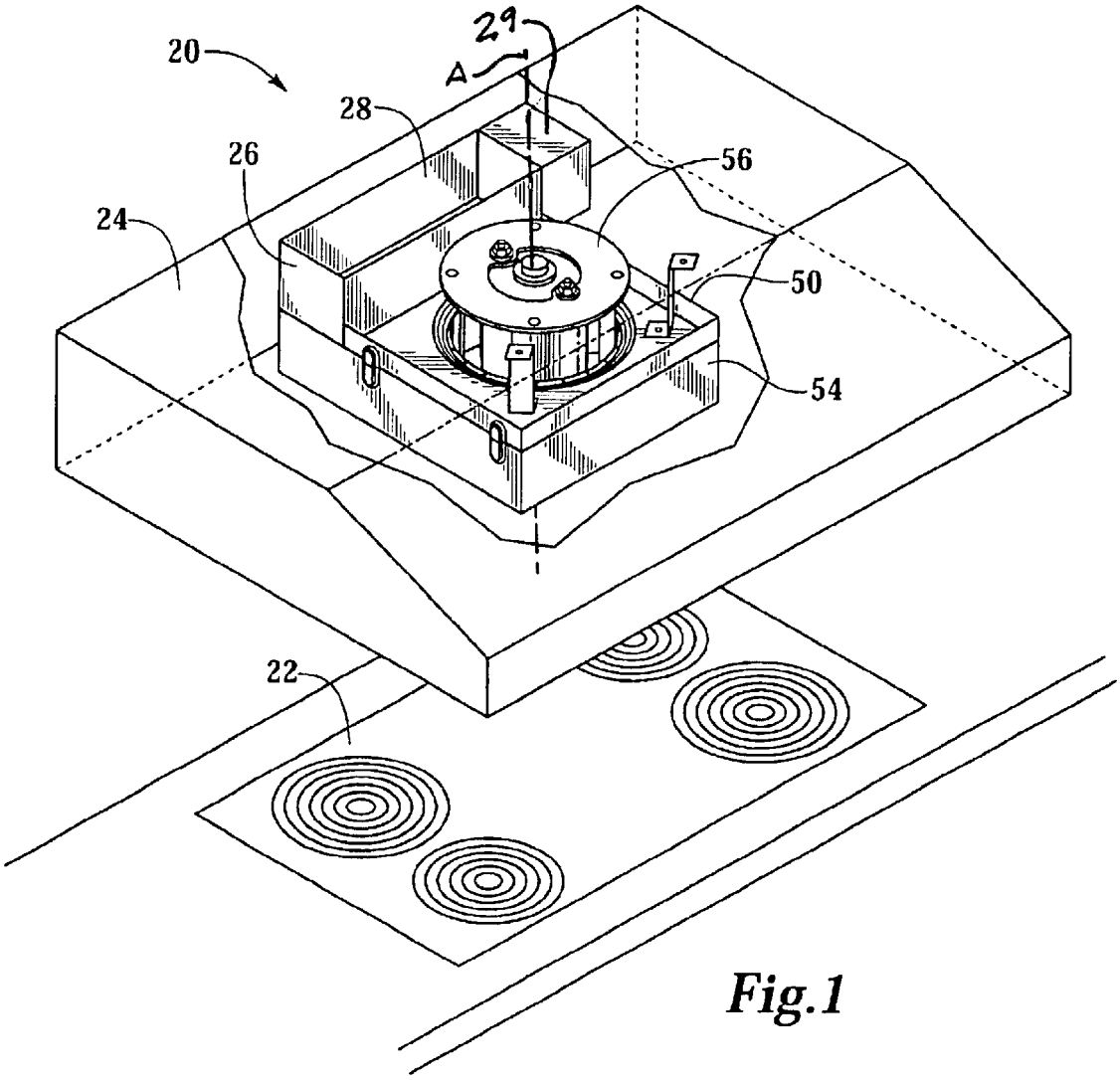
FIG. 1 is a perspective view of a low-profile ventilation system in accordance with the present invention having a single blower unit.

FIG. 1 shows a ventilation system 20 having a single blower unit 26 disposed in a hood 24 in accordance with the present invention. The ventilation system 20 is shown directly above a cooking area 22. The ventilation system 20 comprises a hood 24, a blower unit 26 disposed within the hood 24 and a duct 28 for communicating with the outside environment. Although duct 28 is shown in an upward orientation suitable for directing vapors out the top surface of the ventilation hood 24, it will be appreciated by those of skill in the art that duct 28 may be oriented to direct vapors through the back or sides of ventilation hood 24 without departing from the spirit and scope of the present invention.

The blower unit 26 incorporates an upper plenum frame 50, a lower plenum 54, and a fan assembly 56. The fan assembly 56 has a principal axis A disposed in a vertical orientation. The blower unit 26 is disposed within the hood 24 and designed to have sufficient airflow capacity to evacuate the cooking by-products from within the hood 24 while at the same time liquefying and containing any grease suspended therein. Blower unit 26 may incorporate a speed controller having variable settings, such as a first, second and third setting.

Adjacent to duct 28 is a junction box 29 for safely containing electrical connections and electronics necessary for proper functioning of the ventilation system 20. The hood 24 may also include a light (not shown) and various controls (not shown).

In contrast to prior designs, the blower unit 26 of ventilation hood system 20 draws hot air and cooking by-products in from the upper portion of the hood 24, where such hot air and cooking by-products naturally rise. The hot air and cooking by-products are drawn down into the center of the blower unit 26 by the rotary centrifugal action of the fan assembly 56 disposed in the lower portion of the blower unit 26.

The advantages of the present invention are at least three-fold. First, owing to the manner of orientation of the squirrel cage fan within the blower unit 26 and the intake and exhaust geometry of blower unit 26, ventilation hood system 20 has a lower profile than prior designs having a comparable airflow capacity. Second, owing to the absence of filters and baffles in the airflow stream and the increased efficiency of the blower unit 26, ventilation hood system 20 exhibits a lower noise level than prior designs having a comparable airflow capacity. Third, owing to the efficiency of the blower unit 26 and the intake geometry of the blower unit 26, ventilation hood system 20 accomplishes more efficient scavenging of the ventilation hood 24 as compared to prior designs.

The hood 24 is of sufficient size and design to hold the cooking by-products prior to evacuation from the hood 24, but at the same time the ventilation hood system 20 is designed so that the size of the hood 24 may be minimized, particularly in the vertical dimension. This is done in part by optimizing the airflow through the hood 24 in order to thoroughly evacuate the cooking by-products. As noted above, prior low-profile hoods have been developed, but such hoods have exhibited insufficient airflow capability for use in many applications. Ventilation hood system 20 accomplishes both goals in a compact, low-noise device. As such, ventilation hood system 20 represents a significant improvement over prior ventilation hoods.

Figure 2:
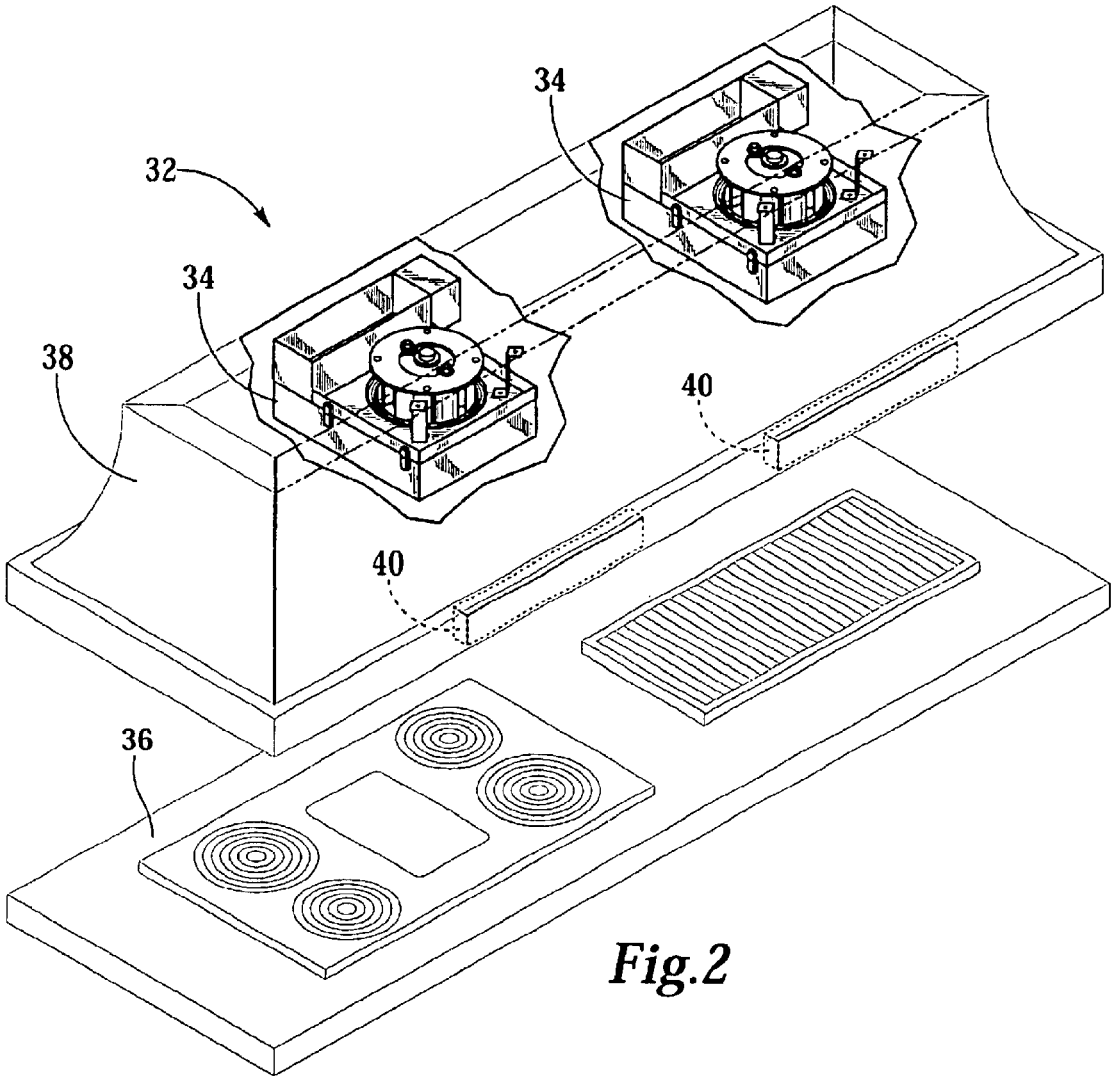
FIG. 2 is a perspective view of a low-profile ventilation system in accordance with the present invention showing the orientation of two back-to-back blower units within the hood.

Now referring to FIG. 2, a ventilation system 32 having a blower system, which comprises two blower units 34 in accordance with the present invention, is shown directly above a cooking area 36. Ventilation system 32 is shown in a cooking island configuration with blower units 34 for complete coverage. The hood 38 contains lights 40 which typically use fluorescent, incandescent or halogen bulbs. The hood 38 may also incorporate a control panel (not shown).

The ventilation system 32 of the present invention comprises several primary elements: a hood 38 of sufficient size and design to hold cooking by-products or contaminants prior to removal; one or more blower units 34 capable of effectively removing the cooking by-products including heat, steam, and odors; filtration provided by each blower unit 34 which is capable of liquefying and containing grease produced from cooking; ducting that is properly sized and configured to vent the cooking by-products out of the kitchen. The combination of these elements provides thorough and safe ventilation of any cooking area 36.

In a similar manner to that described above in connection with ventilation hood system 20, ventilation system 32 works in concert with the natural rising of the heated vapors from the cooking area 36 in order to quietly and efficiently evacuate the heated vapors from the cooking area 36. As with blower units 26, blower units 34 draw heated vapors in from the uppermost regions of the hood 38, thereby evacuating the hottest vapors first. The heated vapors are drawn into the tops of the blower units 34, through the blower units 34 and out through the ducting at the top of the hood 38.

Figure 3:
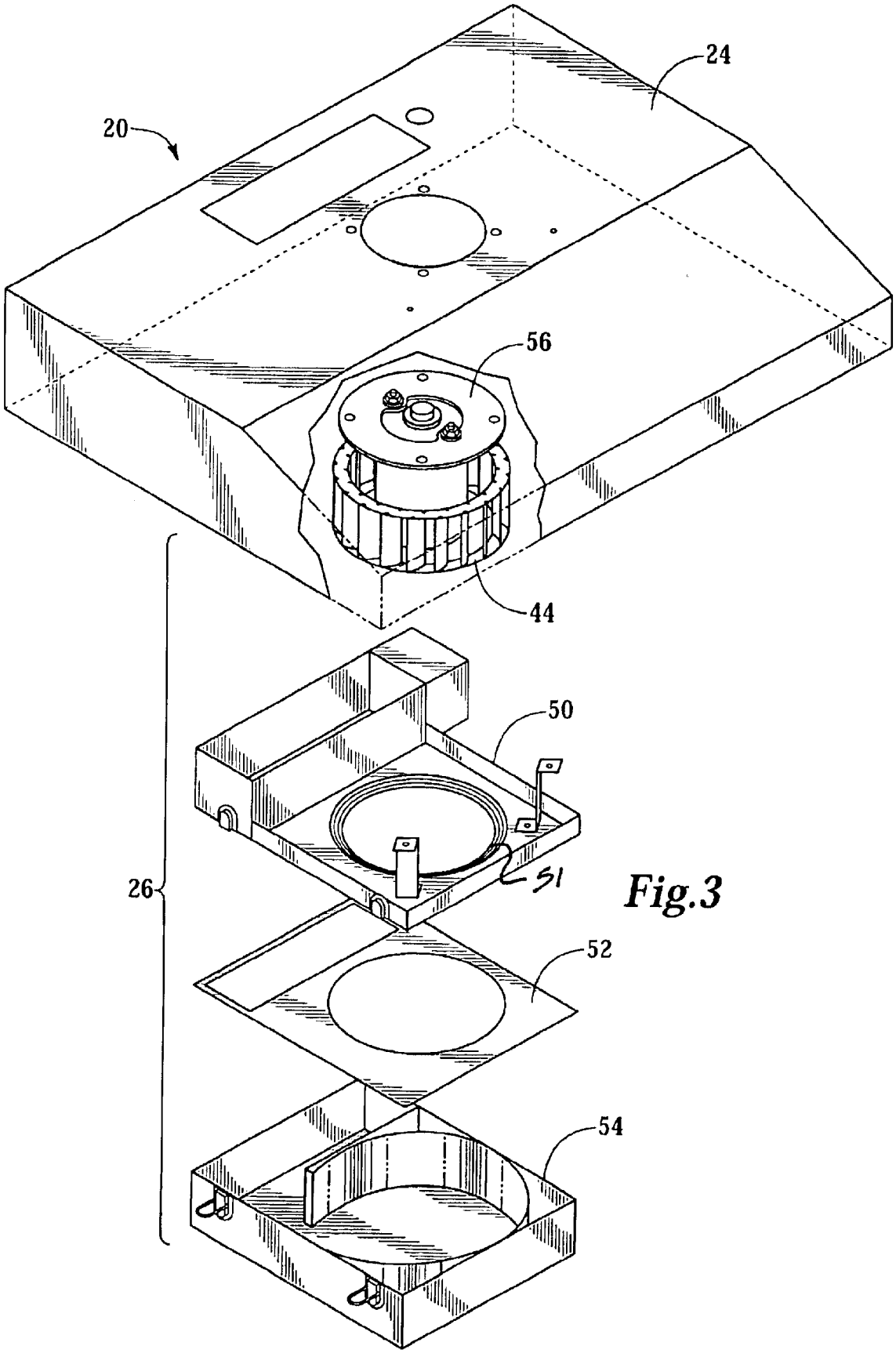
FIG. 3 is an exploded view of a low-profile ventilation hood in accordance with the present invention.

FIG. 3 is an exploded view of a low-profile ventilation system 20 in accordance with the present invention. Ventilation system 20 includes a hood 24 having a blower unit 26 mounted therein. Blower unit 26 is composed of an upper plenum frame 50, a plenum divider 52, a lower plenum 54, and a fan assembly 56 incorporating a squirrel cage fan 44.

In operation, the squirrel cage fan 44, disposed within the lower plenum 54, generates a negative pressure within the center of the squirrel cage fan 44. The squirrel cage fan 44 generates and maintains a corresponding positive pressure within a portion of the lower plenum 54 disposed about squirrel cage fan 44. In certain embodiments, the squirrel cage fan 44 is disposed in the center of the lower plenum 54, while in other embodiments the squirrel cage fan 44 is disposed to one side of the lower plenum 54.

The negative pressure in the center of the squirrel cage fan 44 draws heated vapors down from the region of the hood 24 above the lower plenum 54 and upper plenum frame 50. The heated vapors are drawn through the opening 51 in the center of the upper plenum frame 50 down into the center portion of the squirrel, cage fan 44. In the embodiment shown in FIG. 3, opening 51 has a circular shape with a beveled edge. Other shapes may be employed, depending on application. The centrifugal action of the squirrel cage fan 44 then moves the heated vapors from the center portion of the squirrel cage fan 44 into the portion of the lower plenum 54 disposed about the squirrel cage fan 44.

The positive pressure within the lower plenum 54 moves the heated vapors from the lower plenum 54 up through the duct 28 in upper plenum frame 50, and from there to whatever exhaust ducting may be attached to duct 28.

Figure 4:
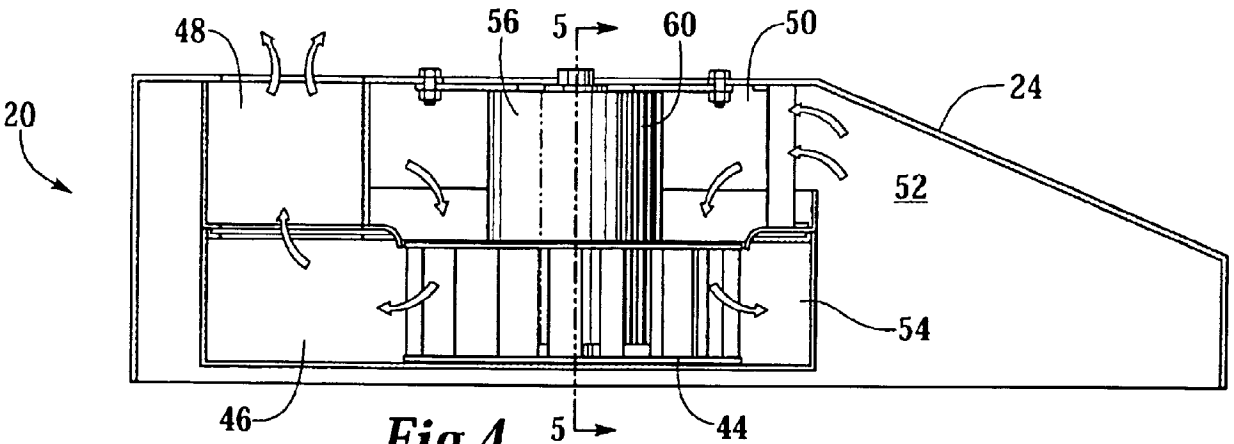
FIG. 4 is a side section view of a low-profile ventilation hood in accordance with the present invention showing the airflow path through the hood.
Figure 5:
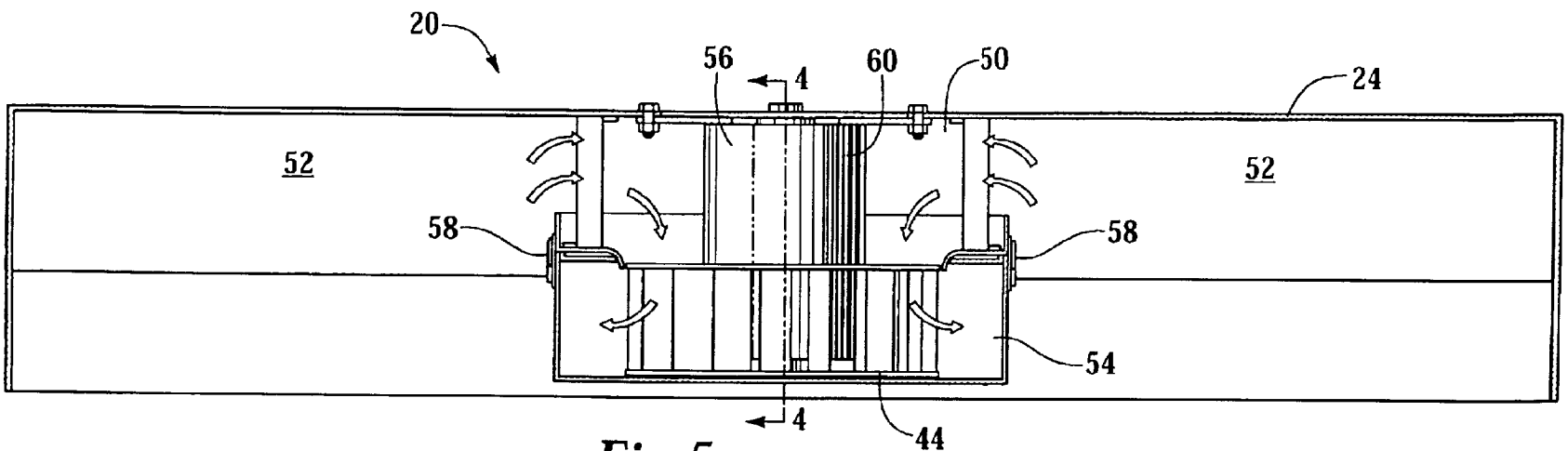
FIG. 5 is a front section view of a low-profile ventilation hood in accordance with the present invention showing the airflow path through the hood.

FIGS. 4 and 5 are side and front sectional views of a ventilation system 20 in accordance with the present invention showing the airflow path. Heated vapors 52 in the upper portion of hood 24 are drawn through an opening in the upper plenum frame 50 down into the center portion of the lower plenum 54 by negative pressure generated by the centrifugal action of fan assembly 56.

A squirrel cage 44 or forward curve blower wheel is attached to motor 60, which may be a single speed or multi-speed motor. The motor 60 is housed within the blower unit 26. In operation, the cooking by-products are spun into the reservoir 46. The housing of the blower unit 26 snaps apart with latches 58 for easy cleaning.

The centrifugal action of the spinning squirrel cage fan 44 of fan assembly 56 powerfully separates grease from heated vapors, spinning the grease and other cooking by-products into reservoir 46. In one embodiment, a blower fan speed of approximately 1550 rpm maintains suitable pressure to liquify grease vapor and provide maximum removal of heated vapors 52. The negative pressure created by the squirrel cage fan 44 also prevents flames from entering the by-product reservoir 46 or exhaust duct 48. As an additional advantage of ventilation system 20, the blower unit 26 is assembled with latches 58 for easy cleaning.

The use of the squirrel cage fan 44 makes the blower unit 26 "fire safe" by successfully trapping grease and other cooking by-products produced by all types of cooking equipment. The centrifugal force created by the squirrel cage fan 44 liquifies grease and stores it safely beyond the fireproof pressure barrier. The blower unit 26 liquifies grease at approximately 1550 rpm.

Owing to the use of latches 58, the squirrel cage fan 44 can be easily removed and cleaned in a dishwasher. If a grease fire occurs, the centrifugal pressure created by the blower unit 26 prevents the flame from entering the exhaust duct 48 and thus controls the area affected by the fire. The hood 24 protects the kitchen walls and ceiling as harmful smoke is exhausted outside. The centrifugal pressure within the blower unit 26 also prevents the liquefied grease in the blower unit 26 from being ignited. As a result, the fire can be controlled with minimal damage.

As illustrated in FIGS. 1 and 2, there are numerous configurations available to handle all ventilation needs. For example, multiple blowers can be specified in larger hoods covering multiple cooking surfaces or commercial equipment.

In addition to being "fire safe," the blower units 26 are very quiet because the centrifugal filtration employed in the present invention requires less airflow (cfm) than equipment using conventional mesh or baffle filtration. In other words, the blower unit 26 does not have a restrictive filter that increases static pressure and noise while decreasing airflow. In addition, in systems using mesh or baffle filters airflow decreases further as grease accumulates on the filters. Baffle filters are even more restrictive, which greatly reduces airflow and thus requires large blowers. Actual airflow (cfm) is determined by static pressure, which includes the resistance of filters, ducting, etc.

The present invention may also incorporate a speed controller, which may be a selector switch, solid state switch or variable speed control, to operate the motor on HIGH, LOW or OFF. Other motor speeds are possible, such as MEDIUM or various intermediate speeds. The different speeds allow a user to select the amount of ventilation required and thus reduces over-exhausting and the noise level of the blower unit. A sensor such as a single pole, single throw thermostat, may be coupled to the speed controller and have normally open contacts that close when a trigger condition occurs, such as a specified temperature rise. Alternatively, the sensor may be a single pole, double throw thermostat with normally open contacts that close, and normally closed contacts that open when the trigger condition occurs. The trigger condition of the sensor is typically set between 122 and 200 degrees Fahrenheit. The actual trigger condition set point varies depending on the sensor's location, the configuration and the heating profile of the cooking equipment and the blower unit used.

Although preferred embodiments of the invention have been described in detail, it will be understood by those skilled in the art that various modifications can be made therein without departing from the spirit and scope of the invention as set forth in the appended claims.

What is claimed is:

1. An apparatus for ventilating a hood, the apparatus comprising:

an upper plenum frame, having an opening disposed in the bottom thereof;

a squirrel cage fan disposed beneath the upper plenum frame, having a center portion having a motor disposed therein and an axis of rotation, the axis of rotation disposed vertically and the center portion of the squirrel cage fan being disposed about the opening in the upper plenum frame; and a lower plenum disposed about the squirrel cage fan and having an outlet.

2. The apparatus of claim 1 wherein the opening in the upper plenum frame is circular.

3. The apparatus of claim 1 wherein the lower plenum has an inside surface having a substantially cylindrical shape.

4. The apparatus of claim 1 wherein the upper plenum frame incorporates a substantially-rectangular plate disposed parallel to an upper surface of the hood.

5. The apparatus of claim 4 wherein the opening in the upper plenum frame comprises a circular hole in the substantially-rectangular plate.

6. The apparatus of claim 4 wherein the substantially-rectangular plate is spaced a fixed distance from an inner surface of the hood, wherein the sides of the upper plenum frame are substantially open, and wherein an open portion on the side of the upper plenum frame comprises an inlet to the upper plenum frame.

7. The apparatus of claim 2. wherein the squirrel cage fan is driven at a speed adequate to liquefy the grease within vapors disposed within the ventilation hood.

8. The apparatus of claim 1 wherein the squirrel cage fan is driven at a speed of 1550 rpm.

9. The apparatus of claim 1 wherein the outlet of the lower plenum is disposed on the side of the lower plenum.

10. An apparatus for ventilating a hood having an upper inner surface, the apparatus comprising:

a substantially-rectangular upper plenum frame, mounted to the hood and disposed substantially parallel to, and a fixed distance from, the upper inner surface of the hood, having a circular opening disposed in the bottom thereof;

a fan motor disposed in the center of the circular opening having an axis of rotation disposed vertically;

a squirrel cage fan disposed about and operably connected to the fan motor, having a center portion disposed about the circular opening in the upper plenum frame; and a lower plenum having a circular inlet disposed in the top thereof connected to the circular outlet of the upper plenum frame and having an outlet on the side thereof.

11. The apparatus of claim 10 wherein the circular opening in the upper plenum frame is beveled to direct airflow through the upper plenum frame.

12. The apparatus of claim 10 wherein the lower plenum has a substantially-cylindrical inner surface.

13. The apparatus of claim 10 wherein two or more sides of the upper plenum frame are open to allow heated air to enter the airspace between the upper plenum frame and the upper inner surface of the hood.

14. The apparatus of claim 10 wherein three sides of the upper plenum frame are open to allow heated air to enter the airspace between the upper plenum frame and the upper inner surface of the hood.

15. The apparatus of claim 10 wherein the upper plenum frame is spaced a fixed distance from the upper inner surface of the hood.

16. The apparatus of claim 10 wherein the squirrel cage fan is driven at a speed adequate to liquefy the grease within vapors disposed within the ventilation hood.

17. The apparatus of claim 10 wherein the squirrel cage fan is driven at a speed of 1550 rpm.

18. The apparatus of claim 10 wherein the outlet of the lower plenum is connected to an exhaust duct.

19. An apparatus for ventilating a hood apparatus having an upper inner surface, the apparatus comprising:

a substantially-rectangular upper plenum frame mounted to the hood and disposed substantially parallel to, and a fixed distance from, the upper inner surface of the hood, having a beveled circular opening disposed in the bottom thereof;

a squirrel cage fan, connected to a fan motor, disposed about the beveled circular opening in the upper plenum frame and having a center portion and an axis of rotation disposed vertically;

a lower plenum disposed about the squirrel cage fan, having an outlet on the side thereof connected to an exhaust duct; and a speed controller operably connected to the fan motor in such a manner to control the speed of the squirrel cage fan.

20. The apparatus of claim 19 wherein the speed controller is an automatic speed controller.

* * * * *